US005526669A

United States Patent [19]

Gjovik et al.

[11] Patent Number: 5,526,669

[45] Date of Patent: Jun. 18, 1996

[54] COMPUTER CONTROLLED PULL GUN SYSTEM

[75] Inventors: Erik Gjovik, Torrance, Calif.; David Wiese, Burlington, Iowa

[73] Assignee: Hi-Shear Corporation, Torrance, Calif.

[21] Appl. No.: 246,658

[22] Filed: May 20, 1994

[51] Int. Cl.[6] ..... B21J 15/28

[52] U.S. Cl. ..... 72/391.2; 72/391.8; 72/19.9; 29/243.523

[58] Field of Search ..... 72/20, 391.2, 391.6, 72/391.8; 29/243.523, 243.524, 243.525

[56] References Cited

U.S. PATENT DOCUMENTS

| | | | |
|---|---|---|---|
| 3,181,338 | 5/1965 | Zetterlund | 72/391.8 |
| 3,654,792 | 4/1972 | Mead | 72/391.8 |
| 4,821,555 | 4/1989 | Kamata et al. | 72/391.8 |
| 5,035,129 | 7/1991 | Denham et al. | 29/243.523 |
| 5,152,162 | 10/1992 | Ferraro et al. | 72/20 |
| 5,323,946 | 6/1994 | O'Connor et al. | 29/243.525 |

FOREIGN PATENT DOCUMENTS

| | | | |
|---|---|---|---|
| 4217901 | 12/1993 | Germany | 29/243.523 |

*Primary Examiner*—David Jones
*Attorney, Agent, or Firm*—Donald D. Mon

[57] ABSTRACT

A computer controlled pull gun system for pulling interference fit fasteners into a mounting hole. The pull gun has a rotatable and axially movable mandrel the is driven by a pneumatic motor. An axially movable piston in a hydraulic cylinder of the pull gun is attached to the mandrel to move it axially after it has been threaded into an interference fit fastener. A digital control system precisely controls the operation to the functions thread mandrel, pull mandrel, unthread mandrel to quickly and efficiently install a fastener. The digital control system controls pressurized fluid pneumatic and hydraulic valves to perform the installation functions. The digital controller responds to commands from buttons on the pull gun that select the functions and determines when a fastener has been properly installed by feedback from a pressure sensing transducer. A reset command button is provided on the pull gun to abort an installation or reset the pull gun for a new installation.

19 Claims, 4 Drawing Sheets

COMPUTER CONTROLLED PULL GUN SYSTEM

FIELD OF THE INVENTION

This invention relates to interference fit fastener pull guns and more particularly relates to a computer controlled interference fit fastener pull gun system.

BACKGROUND OF THE INVENTION

Interference fit fasteners are used in many critical situations and must be properly installed. This is particularly important in the construction of aircraft where structural integrity and safety are of primary importance. Excessive stress on a fastener can weaken the fastener or damage the structure of the component being built. Conversely failure to fully seat a fastener can lead to a weakened area in the structure and may even come loose causing serious safety problems.

Fasteners used in interference fit situations are generally installed with pull guns that draw the fastener into a hole until it is seated. The pull gun has a mandrel that is first threaded into the end of the fastener. The mandrel is then hydraulically pulled back until the fastener seats in the hole.

While these pull guns are efficient and fast they present problems if not properly operated. If an operator does not stop soon enough excessive hydraulic force can be applied damaging the structure or the fastener. If stopped too soon, it may be pulled too little leaving a loose fastener. If a loose fastener is detected, it may be corrected. However, a fastener that is pulled too much may lead to more serious problems. If fastener or structure damage is evident then the part may have to be scrapped causing a substantial loss. Perhaps a more serious problem of safety presents itself if the damage is not detected. For example, a potentially defective aircraft part may be produced. It is therefore very important that interference fit fasteners be set properly.

These problems result from the installation of these fasteners being dependent upon the skill of the pull gun operator. They must have the skill to know when the fastener has been set properly. Having to know this can also reduce efficiency as the operator must take care. It would be advantageous if a properly set fastener could be produced automatically and efficiently. It would reduce assembly time and as a result costs but would also improve quality.

It is therefore one object of the present invention to provide a computer controlled interference fit fastener pull gun system that will correctly install a fastener automatically.

Still another object of the invention is to provide a computer controlled interference fit pull gun system that will abort when a fastener is not properly installed.

Accordingly, another object of the invention is to provide a fastener pull gun system that will stop when the fastener is properly installed.

Another object of the invention is to provide a fastener pull gun system that is less dependent on operator skill.

Another object of the invention is to provide a fastener pull gun that will automatically complete and stop an operation at the proper time when started.

Another object is to provide a fastener pull gun that will quickly and efficiently pull a fastener into an interference fit hole and stop when the fastener is properly seated.

BRIEF DESCRIPTION OF THE INVENTION

The purpose of the present invention is to provide a fastener pull gun that is fast and efficient. All operations are computer controlled thus assuring accurate and proper installation of a fastener.

The fastener pull gun is computer controlled to complete each operation once started. A pre-programmed central processor controls pneumatic and hydraulic operation of the fastener pull gun functions. Controls on the fastener pull gun select the function sequences which are: thread to fastener, pull fastener and unthread from fastener. A reset function is provided to abort or restart a fastener installation function. The latter function will allow an operator to abort a fastener installation and then change or restart the install fastener sequence.

The thread fastener sequence threads a mandrel into the end of a fastener positioned in an interference fit hole. Pressing and holding a button on the pull gun handle selects and starts this function which is stopped when the fastener is properly threaded. The threaded mandrel is driven by a pneumatic motor that threads the mandrel into internal threads in the fastener. The computer controller continually reads button inputs on the handle of the pull gun to await selection of a function. When the thread mandrel function is selected by pressing and holding the appropriate button the control processor activates a pneumatic motor that threads the mandrel into a fastener and stops. When the control processor reads a thread mandrel command, it opens a fluid flow control valve which passes air under pressure to start the pneumatic drive motor rotating and thread the mandrel into the fastener. If the continuous thread mandrel command is interrupted, the control processor clears the signal to the pressurized fluid flow control valve stopping the pneumatic drive motor and waits for another command.

Once the mandrel is properly threaded into a fastener, the control processor will wait for a pull mandrel command activated by selecting another of the buttons on the handle of the pull gun. The threaded mandrel is attached to a piston in a hydraulic cylinder that will pull the mandrel back when a pull mandrel command is selected. When the "pull mandrel" button is selected, the central processor reads the command and sends a signal to start a hydraulic pump in a hydraulic power unit. The control processor opens a pressurized hydraulic fluid flow control valve allowing fluid to fill a cylinder in the pull Gun to drive the piston with the threaded mandrel back with the attached fastener. The control processor reads a signal from pressure transducer or sensor that is converted from analog-to-digital form and analyzes a chain of data to determine when the head of the fastener has reached the "set position." The control processor reads approximately ten data points representing load pressure with respect to position or time. The differences of these data points are compared with a defined head seat value. When all the differences of the data points are greater than the defined head seat value, the system is cut off.

When this occurs or when the continuous "pull mandrel" function is interrupted, the central processor will send a signal to shut down the hydraulic pump and valve and return the piston in the cylinder to its initial pulling position. If the fastener "head seat" condition occurs or is detected, the central processor will clear the chain of data readying itself for a new stream of data. The central processor then waits for another function command.

The sensing of a head seat condition is performed by a computer program subroutine that holds, in current memory, a chain of approximately ten data points. These data points represent samplings of the pressure from a transducer. The number of data points can be more or less depending upon the functional criteria of the installation tool. A tool pull mandrel subroutine calculates the differences between respective data points and compares each of the differences against a defined "head seat" value. This head seat value represents a spike that occurs when the head of a pin seats. Thus, if any of the differences of the ten data points is less than the defined head seat value, no head seat condition is indicated.

The program subroutine continues to read data points and calculates differences by adding a new data point at the beginning of a data chain while dropping the last data point. This program subroutine continues within its loop. The purpose of selecting a number of data points is to determine when the spike indicating a head seat condition occurs. This prevents an intermediate spike from incorrectly indicating a head seat condition. If a spike should occur in one data point, but not in subsequent data points, the system will continue to pull the pin until all the data points indicate a difference that is greater than the defined head seat condition.

The program provides the unique function of allowing use of the system with different sizes or diameters of pull pins. The system will work the same with all types and sizes of pull pins to indicate when the spike or head seat condition event has occurred.

As described above, the program subroutine continues to calculate the differences between respective data point samples until all of the differences of the ten data points retained in memory are greater than the defined head seat value. When this occurs, the system will cut the voltage to a hydraulic pump solenoid, set a DONE flag, set a CLEAR DATA CHAIN flag, and exit the main portion of the program. The next time a pull mandrel function (i.e., PULL-PIN) is executed, the data chain will be cleared because the CLEAR DATA CHAIN flag has been set during the successful head seat in the previous pull pin execution.

After a fastener is seated, an unthread mandrel command is sent to the controller by selecting the appropriate button, it sends a signal to a pneumatic valve which reverses the pneumatic motor and unthreads the mandrel from the fastener. If the continuous unthread mandrel command is interrupted, the central processor clears the signal to the pneumatic valve and waits for selection of another function.

The fastener pull gun system also includes a reset function selected by a button on the pull gun handle. When the reset function is selected, a flag is set to erase the data chain allowing the system to be reset for a new fastener installation. A clear flag function is provided by selecting the "pull mandrel" and "reset" buttons at the same time. This returns the data chain to the original data and the current fastener can continue to be installed. The reset function allows an operator to abort a current fastener installation at any time.

The above and other novel features of this invention will be fully understood from the following detailed description and the accompanying drawings, in which:

DETAILED DESCRIPTION OF THE INVENTION

Figure 1:
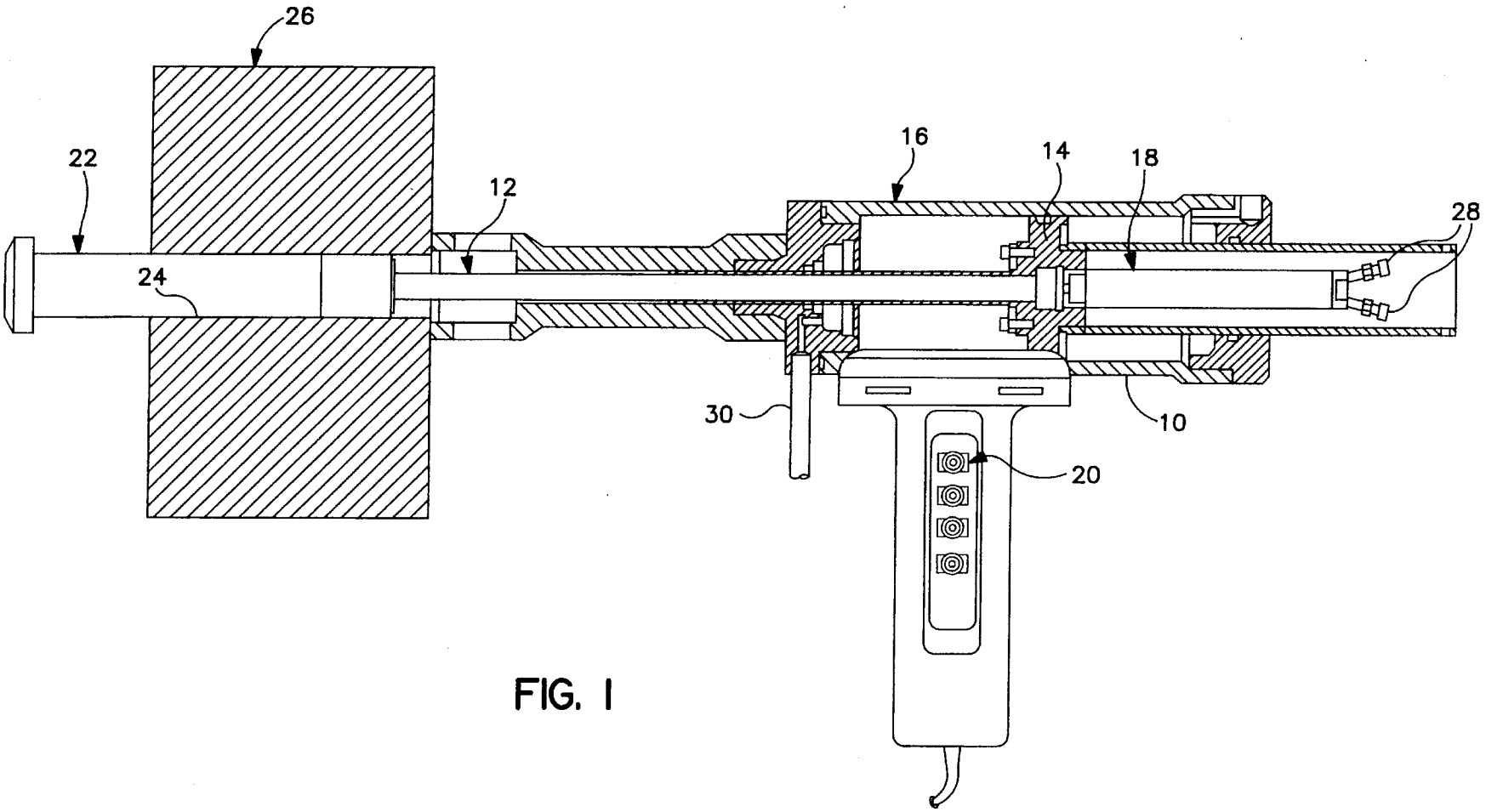
FIG. 1 is a diagram of a interference fastener pull gun computer control system.

FIG. 1 is a diagram of a computer controlled interference fit pull gun system constructed according to the invention. Pull gun 10 is a hand held electro mechanical hydraulic pull gun that installs fasteners in interference fit applications. Pull gun 10 is comprised of rotatable and axially movable threaded mandrel 12, piston 14 attached to the threaded mandrel, hydraulic cylinder 16, and fluid pressure driven pneumatic motor 18, receiving air from a programmable central processing unit which will be described in greater detail here and after. Pull gun 10 has a series of buttons 20 for selecting various functions. These functions are thread mandrel, pull mandrel, unthread mandrel and reset. A control system reads signals from the series of inputs buttons 20 to provide each function as will be described in greater detail hereinafter.

Rotatable threaded mandrel 12 is attached to pneumatic motor 18 and piston 14. Pneumatic motor 18 rotationally drives mandrel to thread and unthread it into and out of fastener 22 positioned in hole 24 in structure 26. Operation of pull gun 10 pulls fastener 22 attached to threaded mandrel 12 and piston 14 into interference fit hole 24 in structure 26. Air connectors 28 connect pneumatic motor 18 to a source of air under pressure. Hydraulic fluid conduit 30 connects cylinder 16 to a source of pressurized hydraulic fluid to drive piston 14. Fluid flows into and out of cylinder 16 to hydraulic fluid conduit 30 to move piston 14 forward and back with mandrel 12. Air to drive mandrel 12 is supplied to pneumatic fittings 28 to drive mandrel in a clockwise direction to thread it into fastener 22 or in a counter clockwise direction to unthread it.

Figure 2:
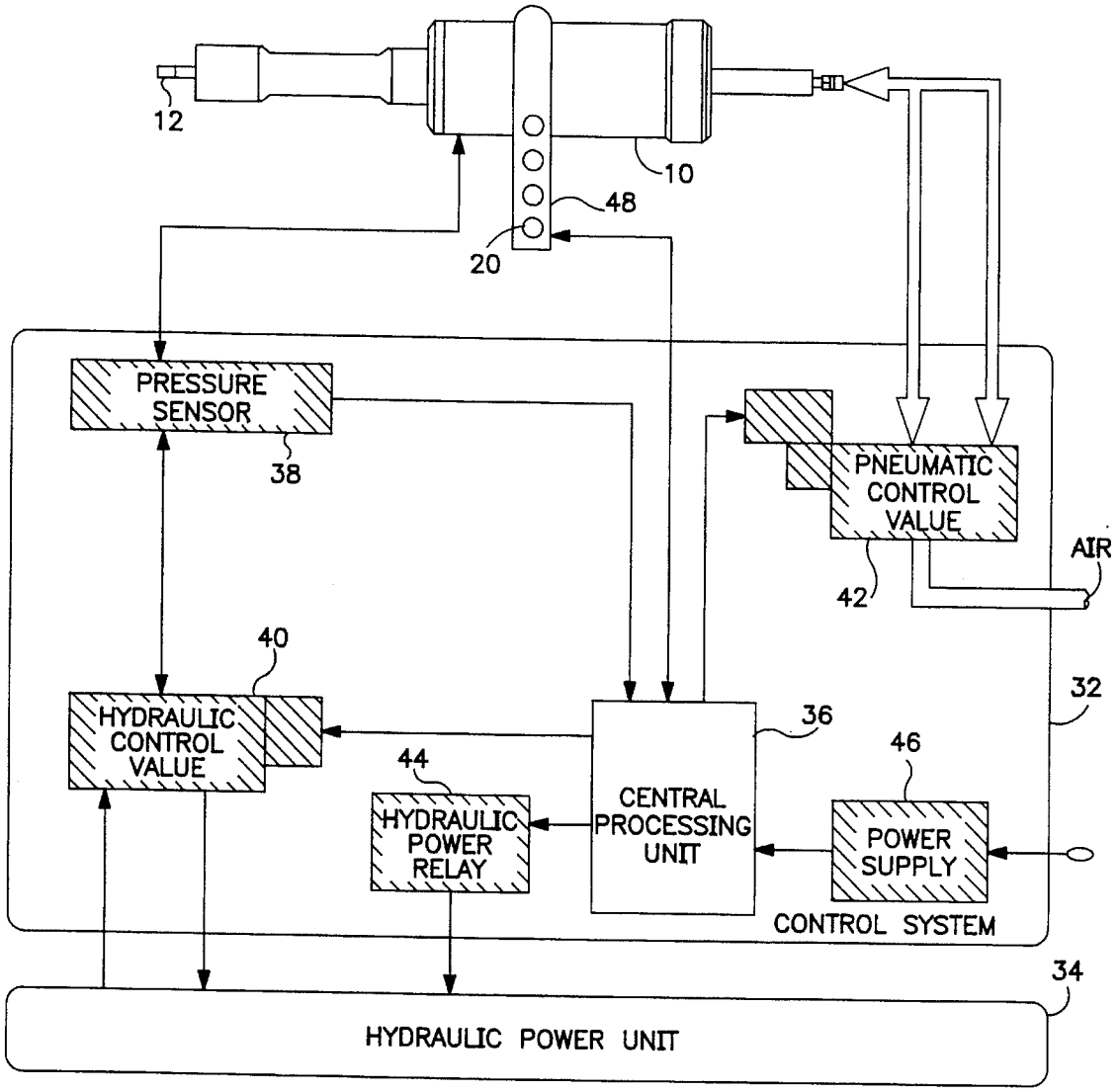
FIG. 2 is a partial sectional view in schematic form illustrating instillation of an interference fit fastener with the computer control pull gun system.

The operation of pull gun 10 is computer controlled to assure accurate installation of interference fit fasteners. The computer control system is illustrated in FIG. 2 and is comprised of control system 32 and pressurized hydraulic fluid power unit 34 that provides hydraulic power to pull gun 10. Central processing unit 36 controls operation of pressure sensor 38, pressurized hydraulic fluid flow control valve 40, pneumatic fluid flow control valve 42, and hydraulic power relay 44. Selection of a function by pressing and holding one of the buttons 20 sends a signal to central processing unit 36 to operate pull gun 10 in accordance to a preprogrammed sequence.

Selection, for example, of a thread mandrel function by pressing and holding a button 20 on pull gun 10 sends a command to central processor unit 36. Central processor unit 36 responds by sending a signal to pneumatic control valve 42 to operate pneumatic motor 18 (FIG. 1) to thread mandrel 12 into fastener 22. The threading of mandrel into fastener 22 is controlled by data stored in central processing unit 36.

Once mandrel 12 has been threaded into fastener 22, the function pull mandrel is selected by pressing and holding a button 20 on handle 48 of pull gun 10 to send another command to central processor unit 36. Central processor unit then processes data stored in its memory to operate hydraulic control valve 40, and hydraulic power relay 44.

Hydraulic control valve 40 is a two way valve that controls flow of hydraulic fluid from hydraulic power unit 34 to and from cylinder 16 in pull gun 10. Hydraulic power relay 44 turns on hydraulic power unit 34 to activate a pump to pump hydraulic fluid to pull gun 10.

When the pull mandrel function is selected hydraulic control valve 40 and hydraulic power relay are activated to pump hydraulic fluid to cylinder 16 in pull gun 10 to retract mandrel 12 to pull fastener 22 into interference fit hole 24 in structure 26. When fastener 22 is fully seated according to pressure sensed in pressure sensor 38 a signal is sent to central processing unit 36 to turn off the hydraulic power. This allows hydraulic fluid to flow back to the hydraulic power unit 34 returning piston 14 in cylinder 16 to its initial pulling position. If the head of fastener 22 is properly seated the chain of data in central processing unit 36 is cleared readying it for a new data chain. Control system 32 then awaits selection of another function from buttons 20 on handle 48 of pull gun 10. If a function is interrupted by releasing a button 20 data is held in memory until cleared or the function is resumed.

The system is controlled by a computer program that will be described hereinafter. The pull mandrel function is controlled by a subroutine which holds, in memory, approximately ten data points representing samples of the pressure when the pull mandrel function has been activated. The number of data points can be more or less depending upon the functional criteria of the installation tool. It has been found that ten data points are sufficient to accurately determine when a head seat condition has been reached. The purpose of sampling and storing, in memory, ten data points is to determine when a voltage spike caused by the sudden change in pressure when a head of a pin is seated has occurred.

The program calculates the differences between each respective data point and compares the difference against the defined "head seat" value. Not until all the differences of the ten data points are equal to or exceed the defined head seat value will the system stop pulling the mandrel. When all of the differences are equal to or greater than the defined head seat value the voltage from power supply 46 will be cut off and the system will stop. This prevents an intermediate spike from shutting down the system. As long as the button remains pressed, the system continues to sample data points adding the new ones and dropping the earlier data points. When all of the differences of the data points exceed a defined value, indicating a spike representing a head seat condition has occurred, the system will shut down. Until that time the differences will indicate a gradual slope of increasing values from a continuous pull on the mandrel.

If fastener 22 is properly seated an unthread command is sent by selecting the appropriate button 20 on pull gun 10 sending a signal to central processor unit 36. In turn central processor unit 36 reverses the flow of air from pneumatic control valve to pneumatic motor 18 reversing the operation of mandrel 12 to unthread the mandrel from fastener 22. Power is supplied for this system by a standard power supply 46.

Figure 3:
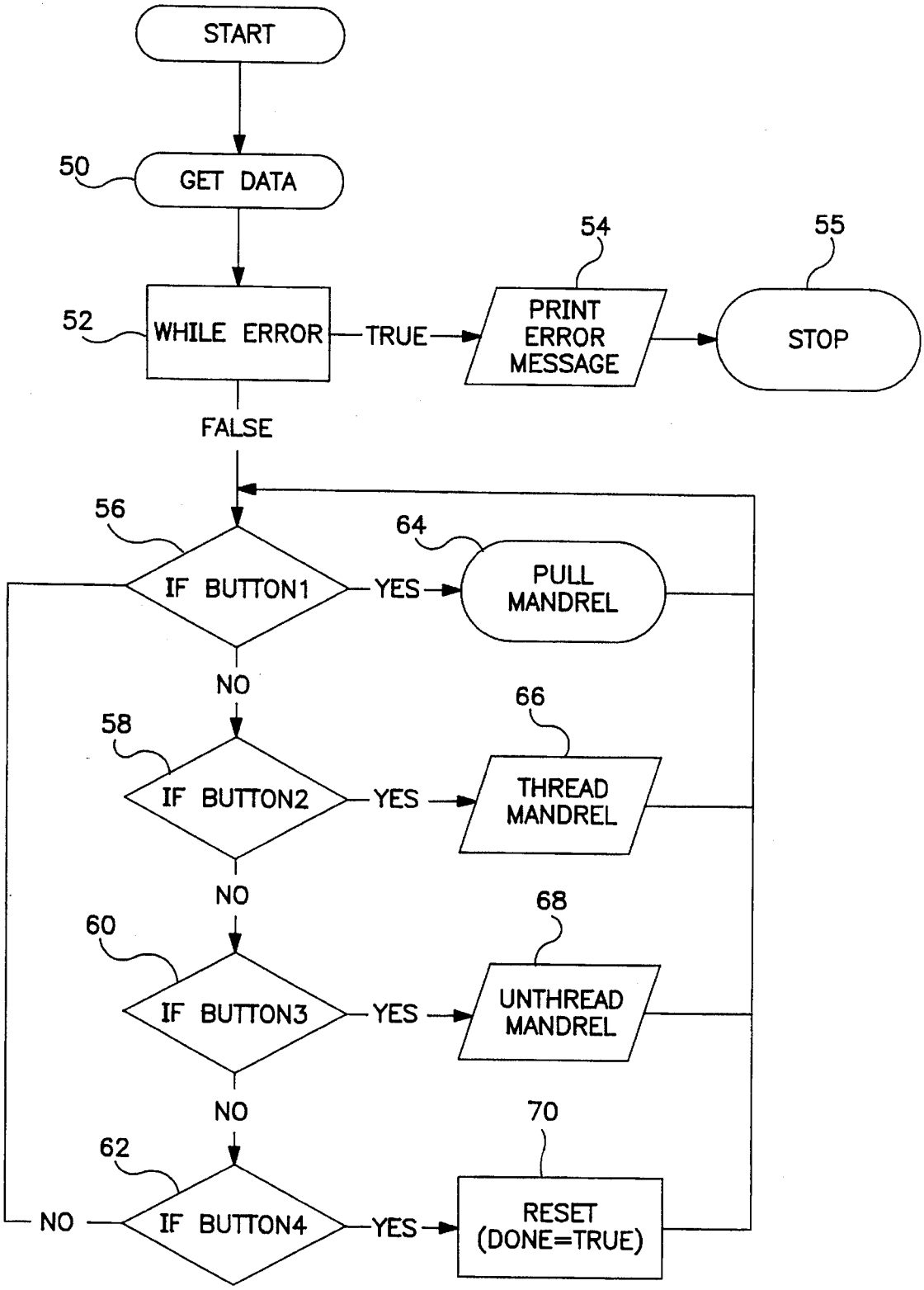
FIG. 3 is a flow diagram illustration the operation of the computer controlled interference fit pull gun system.
Figure 4:
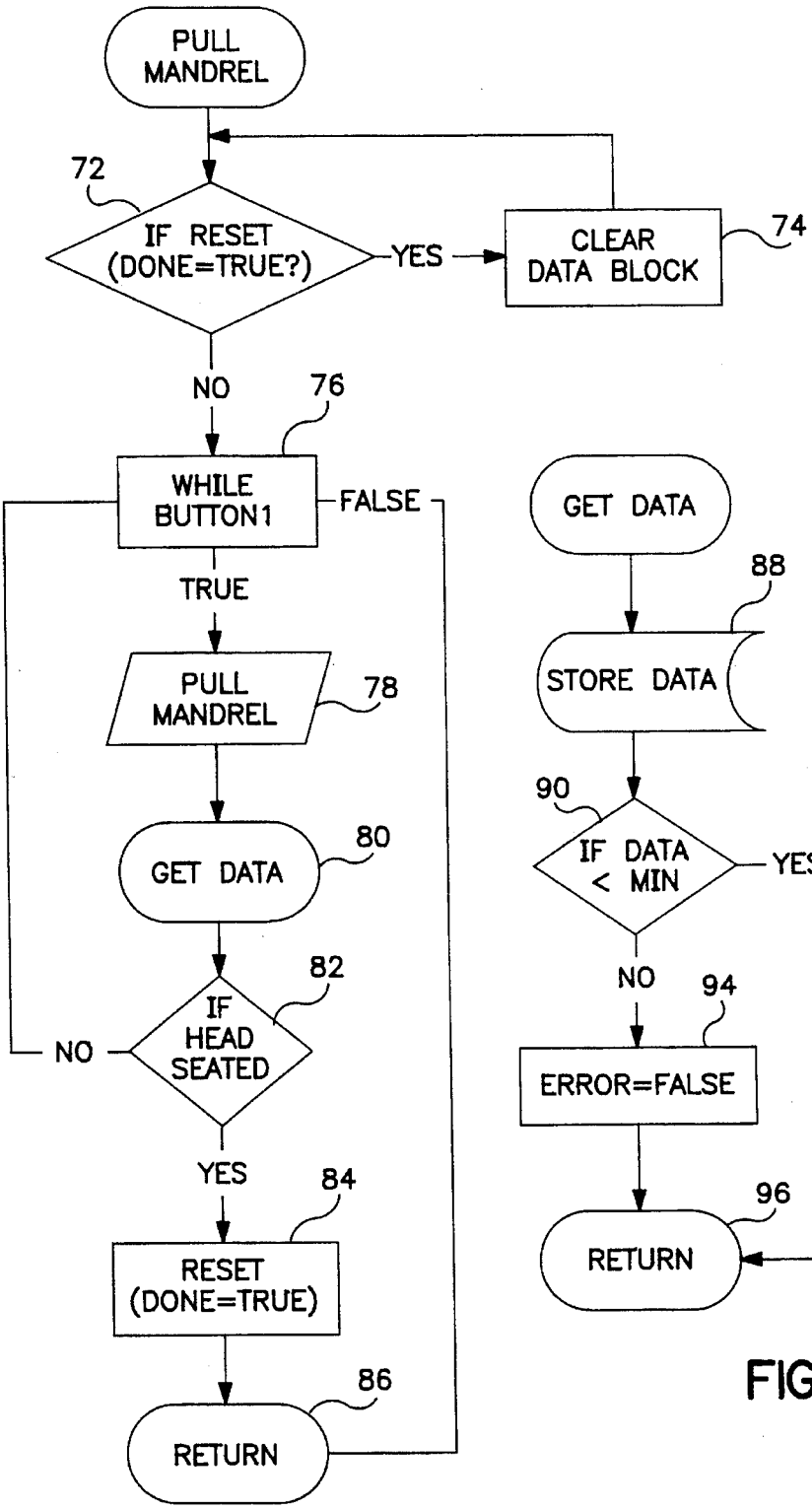
FIG. 4 is a flow diagram of a program Pull Mandrel subroutine to operate the computer control pull gun interference fit pull gun system.
Figure 5:
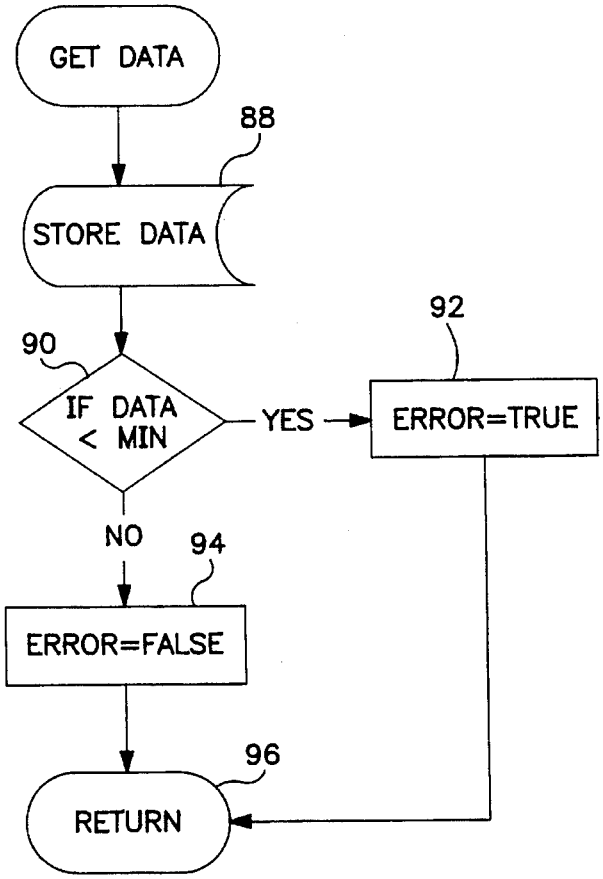
FIG. 5 is a flow diagram illustration of a Get Data subroutine for the computer control interference fit pull gun system.

The program for operating the system stored in central processing unit 36 is illustrated in FIGS. 3 through 5. The program is comprised of subroutines which include get data subroutine 50 and button selection subroutines which will be described in greater detail hereinafter. While error subroutine 52 determines if there is an error during the operation of pull gun 10. If there is any error, print error message subroutine 54 provides an error message to STOP subroutine 55 to stop operation of the system. If WHILE ERROR subroutine 52 detects a false condition, then the system proceeds according to the function selected. Subroutines 56, 58, 60 and 62 represent selection of one of four functions by buttons 20 on handle 48 of pull gun 10. When thread mandrel function is selected if button 2 subroutine 58 initiates operation of the components to thread mandrel 12 into fastener 22. Then PULL MANDREL (i.e., PULL PIN) subroutine 56 is then selected by pressing and holding another button and PULL MANDREL subroutine 64 is initiated.

PULL MANDREL subroutine 64 is illustrated in FIG. 4. PULL MANDREL subroutine has a RESET subroutine that proceeds to clear data block subroutine 74 or proceeds to pull the mandrel through when button subroutine 76 is initiated. If a reset signal has been sent then CLEAR DATA BLOCK subroutine 74 clears all data from central processor unit and awaits another pull mandrel command. If the pull mandrel command is not interrupted then WHILE BUTTON subroutine 76 sends a true signal to PULL MANDREL subroutine 78 to pull mandrel 12 to seat fastener 22. If HEAD SEATED subroutine 88 reads inputs from pressure sensor 38 to determine if the head is seated. If the head is not seated the system will continue to pull until it is seated then it will proceed to the RESET subroutine 84. When fully seated a reset signal returns the system to a ready status for installation of another fastener. If the system is interrupted during the pull mandrel subroutine a false output is sent from button 1 subroutine 76 to return and stop the system.

The GET DATA subroutine 80 shown in FIG. 5 retrieves data stored in the memory of central processing unit 36 to control operation during one of the four functions selected. The GET DATA subroutine 80 determines if the data received from an input button selected or the pressure center are correct and indicates whether or not a head seat condition has occurred or an error has occurred. GET DATA subroutine 80 stores data received during operation of pull gun 10 in STORE DATA subroutine 88. IF DATA subroutine 90 compares the data with stored data to determine whether it is less than a certain minimum. If it is less than a certain minimum then the error=TRUE subroutine 92 is processed to continue with the function selected. If the data comparison indicates the data is not less than the minimum then error equals false subroutine 94 proceeds to RETURN subroutine 96 completing the function selected. GET DATA subroutine 50 gets data stored in the memory of central processing unit 36 that indicates optimum conditions for installation of fastener 22. If the data comparison routine detects any error in the data during an installation the system will abort stopping operation of pull gun 10.

The PULL MANDREL and GET DATA subroutines illustrated in FIGS. 4 and 5 determine when a head seat condition exists. GET DATA subroutine 80, illustrated in greater detail in FIG. 5, samples and stores up to ten data points. There may be more or less data points depending upon the functional criteria of the installation tool. PULL MANDREL subroutine 78 calculates the difference between each of these respective data points and compares each of the differences against a defined "head seat" value in DATA subroutine 90. If any of the differences of the ten data points are less than the defined head seat value, PULL MANDREL subroutine 78 will read another data point as long as WHILE BUTTON 1, subroutine 76 indicates the button is still being pressed and add that data point to the beginning of the data chain, dropping the last data point. The subroutines shown in FIGS. 4 and 5 will then continue within the loop as long as any value remains less than the defined head seat value.

If HEAD SEATED subroutine 82 continues the loop as long as any of the differences are less than the defined head seat value.

When all of the differences of the ten data points are greater than the defined head seat value, if HEAD SEATED subroutine 82 proceeds to RESET subroutine 84. This cuts off the voltage from the hydraulic pump solenoid and a DONE flag is set. At this time, a CLEAR DATA CHAIN flag is set and the system exits to the main portion of the program. The next time PULL MANDREL subroutine, illustrated in FIG. 4 executes, it will clear the data chain in STORE DATA subroutine 88 because the CLEAR DATA CHAIN flag has been set during the successful head seat in the previous pull mandrel execution. If the button is released in the middle of an operation, then WHILE BUTTON 1 subroutine 76 will indicate a false proceeding to the RETURN subroutine 86. Prior data points will remain stored in memory until the reset button is pressed. If the pull mandrel button is again pressed and held, WHILE BUTTON 1 subroutine 76 proceeds to send data points to PULL MANDREL subroutine 78 to complete the seating of a pin.

The purpose of selecting a chain of ten data points is to allow the system to operate and function with different size pins. Also, the continuous sampling of data prevents a spike in one data point from aborting the system. If one data point should ever spike and the next data point is normal, then the system will continue because of the requirement that all of the differences calculated in the data points exceed the defined head seat value. Thus, until all of the data points exceed this value no head seat condition is detected and the pull mandrel function will continue.

An additional function provided by the system is a reset selected by one of the buttons on 20 on pull gun 10. If a reset is selected the system cam be reset for installing another fastener. If a reset is selected simultaneously with a pull mandrel function the system will reset to continue pulling the current fastener.

The system disclosed and described operates as follows. A fastener 22 is positioned in hole 24 in structure 26. When control system 32 receives a continuous "thread" manual signal by selection of the appropriate button 20 on pull gun 10 a signal is sent to open pneumatic valve 42 which starts pneumatic motor 18 to thread mandrel 12 into fastener 22. If the continuous thread manual function is interrupted central processing unit 36 clears the signal to pneumatic valve 42 and waits for selection of another function.

If mandrel 12 is properly threaded into fastener 22 and a continuous "pull mandrel" function is received by selection of the appropriate button 20 on pull gun 10 central processing unit 36 sends a signal to hydraulic power relay 44 to start a hydraulic pump in hydraulic power unit 34 and activates hydraulic control valve 40. This send hydraulic fluid through pressure sensor 38 into cylinder 16 of pull gun 10. This axially pulls piston 14 with threaded mandrel 12 and fastener 22. Central processing unit 36 reads and analog-to-digital signal (i.e. a voltage from pressure sensor 38) and analyzes a chain of data stored in its memory to determine when a "head seat" has occurred. When central processing unit 36 determines the head of fastener 22 has been seated or when the continuous pull mandrel routine is interrupted control system 32 will shut down hydraulic power unit 34 and return piston 14 in cylinder 16 to the initial pulling position. If a head seat event is detected control system 32 clears the chain of data readying itself for a new data chain. Central processing unit 36 then waits selection of another function command.

After a head seat has been properly detected and central processing unit 36 receives a continuous "unthread mandrel" command selected by a button 20 on pull gun 10 then a signal is sent to open pneumatic valve 42 which reverses pneumatic motor 18 and unthreads mandrel 12 from fastener 22. If the continuous unthread mandrel function is interrupted control system clears the signal to pneumatic control valve 42 and waits for selection of another function command.

Whenever a reset is selected by one of the buttons 20 on handle 48 of pull gun 10 a flag is set in central processing unit 46 erasing the data chain to allow pull gun installation tool 10 to be set for a new fastener installation. The flag can be cleared by sending a pull mandrel and reset commands simultaneously to central processing unit 36 by selecting appropriate buttons 20 on pull gun 10 at the same time. When this function is selected the data chain being read is retained and the current fastener can continue to be installed. A particular advantage of the reset function is it allows the pull gun operator to abort the installation of a current interference fit fastener at any time.

Thus there has been disclosed a unique pull gun fastening system that automatically installs and seats interference fit fasteners. The system includes a pull gun operated by a computer control system that automatically detects and operates a mandrel to seat a fastener in a hole. The system insures quick complete installation of fasteners and indicates any error conditions during the operation. It allows fasteners to be quickly installed and minimizes the skill needed by the tool operator.

This invention is not to be limited by the embodiment shown in the drawings and described in the description which is given by way of example and not of limitation, but only in accordance with the scope of the appended claims.

What is claimed is:

1. A computer controlled interference fit fastener pull gun system comprising;

a body having a hydraulic cylinder;

a rotatable and axially movable threaded mandrel in said cylinder;

a piston in said cylinder connected to said threaded mandrel to move axially therewith;

fluid pressure driven motor means for rotating said threaded mandrel to thread and unthread said mandrel from a fastener;

pressurized fluid supply means for supplying pressurized fluid to said cylinder to axially move said piston with said threaded mandrel;

computer control means for controlling operation of said pneumatically driven motor to thread and unthread said threaded mandrel from said fastener and control the supply of hydraulic fluid to and from said cylinder;

whereby threading and pulling an interference fit fastener into a hole is precisely controlled.

2. The system according to claim 1 in which said computer control means comprises;

a fluid flow control valve controlling fluid flow to said fluid pressure driven motor means;

a pressurized fluid flow control valve for controlling fluid flow from said pressurized fluid supply means;

pre-programed central processing means for controlling said fluid flow control valve and said pressurized fluid flow control valve;

fluid pressure sensing means for sensing the pressure of said pressurized fluid to said cylinder and provide an output signal to said preprogrammed central processing means; whereby said central processor controls said pressurized fluid control valve to stop the flow of pressurized fluid to said cylinder when a fastener is properly seated.

3. The system according to claim 2 including means on said pull gun to send thread mandrel, pull mandrel and unthread mandrel commands to said central processing means.

4. The system according to claim 3 including means on said pull gun for sending a reset signal to said central processor to interrupt a fastener installation at any time.

5. The system according to claim 4 in which said central processor is preprogrammed to retain install data when a pull mandrel and reset command signals are simultaneously sent from said pull gun.

6. The system according to claim 3 in which said fluid flow control valve is a reversible valve to reverse the flow of fluid to said fluid driven motor means to thread and unthread said mandrel from said fastener.

7. The system according to claim 4 in which said reset signal clears all installation data from said central processor preparing said control system to install another fastener.

8. The system according to claim 1 in which said pressurized fluid supply means comprises; a pressurized fluid drive unit; and relay means connecting said pressurized fluid drive unit to said computer control means to turn on said pressurized fluid drive unit when a pull mandrel command is received.

9. The system according to claim 2 in which said central processing means includes memory means, said memory means storing a defined head seat value; sampling means for continuously sampling a series of signals from said fluid pressure sensing means; storage means for storing a data chain representing a series of said signals sampled by said sampling means; and comparing means comparing said defined head seat value; whereby when said head seat value is reached said pull gun system is cut off.

10. The system according to claim 9 in which said comparing means compares a plurality of signals in said data chain with said defined head seat value: said comparing means adapted to cut off said pull gun system when a plurality of signals in said data chain equal or exceed said defined head seat value.

11. The system according to claim 10 in which said data chain comprises at least ten data points.

12. The system according to claim 10 wherein said comparing means cuts off said pull gun system when a characteristic of all signals in said data chain equal or exceed said defined head seat value.

13. The system according to claim 12 wherein said comparing means includes calculating means calculating the difference between respective signals in said data chain; said comparing means cutting off said pull gun system when all said calculated differences equal or exceed said defined head seat value.

14. The system according to claim 10 wherein said comparing means includes calculating means calculating the difference between respective signals in said data chain; said comparing means cutting off said pull gun system whereas all said calculated differences equal or exceed said defined head seat value.

15. A method of controlling the operation of a hydraulically operated pull gun to assure proper installation of pull pins comprising;

threading a mandrel on said pull gun to a pull pin;

activating said pull gun to pull said mandrel with said pull pin attached;

sensing the pressure of the hydraulic fluid when said pull gun is activated;

sampling the sensed pressure to produce a series of data points representing the hydraulic pressure sensed;

processing said data points to produce a data chain;

comparing respective data points in said data chain with predetermined data points representing a defined head set value;

deactivating said pull gun when said compared data points equal or exceed the defined head seat value.

16. The method according to claim 15 in which said sampling of said hydraulic pressure produces ten data points in said data chain.

17. The method according to claim 16 in which said pull gun is deactivated when all ten data points indicate said pull pin has been seated.

18. The method according to claim 15 in which comparing said respective data points comprises calculating the difference between respective data points; comparing the differences against differences representing a defined head seat value; deactivating said pull gun when said calculated differences equal or exceed the differences representing a defined head seat value.

19. The method according to claim 18 in which said sampling of hydraulic pressure produces a data chain of ten data points; deactivating said pull gun when the calculated difference of all ten data points in said data chain equal or exceeds said defined head seat value.

* * * * *